US006540476B2

(12) United States Patent
Huang et al.

(10) Patent No.: US 6,540,476 B2
(45) Date of Patent: Apr. 1, 2003

(54) CENTRIFUGAL FAN

(75) Inventors: Yuhung Huang, Taoyuan Hsien (TW); Bor Haw Chang, Taoyuan Hsien (TW); Tsu Liang Lin, Taoyuan Hsien (TW); Kuo-Cheng Lin, Taoyuan Hsien (TW); Wen-Shi Huang, Taoyuan Hsien (TW)

(73) Assignee: Delta Electronics, Inc., Taoyuan Sien (TW)

( * ) Notice: Subject to any disclaimer, the term of this patent is extended or adjusted under 35 U.S.C. 154(b) by 0 days.

(21) Appl. No.: 09/953,324

(22) Filed: Sep. 17, 2001

(65) Prior Publication Data

US 2002/0057965 A1 May 16, 2002

(30) Foreign Application Priority Data

Nov. 16, 2000 (TW) ..... 89219863 U

(51) Int. Cl.[7] ..... F01D 3/02

(52) U.S. Cl. ..... 415/98; 415/102; 415/119; 416/231 B; 416/185; 416/184

(58) Field of Search ..... 415/98, 102, 119, 415/206; 416/182, 183, 184, 185, 228, 231 B, 203

(56) References Cited

U.S. PATENT DOCUMENTS 6,435,828 B1 * 8/2002 Bostwick ..... 416/175

FOREIGN PATENT DOCUMENTS

GB 2027816 A * 2/1980 ..... F04D/29/24

* cited by examiner

*Primary Examiner*—Edward K. Look
*Assistant Examiner*—Dwayne J. White
(74) *Attorney, Agent, or Firm*—Intellectual Property Solutions, Incorporated

(57) ABSTRACT

The centrifugal fan of the present invention comprises a frame, a rotatory means and an impeller. Among these, the frame has a first intake, a second intake, at least one air outlet and a plurality of ribs crossing the second intake. The rotatory means mounted in the frame. The impeller further includes a hub, a partition, a plurality of first blades and a plurality of second blades. The hub is coupled to the motor. The partition separates the inlet air of the first intake and that of the second intake so as to reduce the noise caused by the disturbance. A plurality of first blades and second blades are formed on the first surface and the second of the impeller, respectively. Each of the first blades and second blades selectively include a cut corner formed thereon. The second blade and said rib forms an intersection angle of about 90 degrees as the second blade crosses the rib.

20 Claims, 8 Drawing Sheets

CENTRIFUGAL FAN

BACKGROUND OF THE INVENTION

1. Field of the Invention

The present invention relates to a centrifugal fan, and more particularly to a centrifugal fan improved to reduce the noise.

2. Description of the Prior Art

Generally, the conventional centrifugal fan as shown in FIG. 1(*a*) is composed of a frame 10, a motor 20 and an impeller 30. Among these, the frame 10 includes a intake 11 and an outlet(not shown). The motor 20 mounted to the frame 10 is used to rotate the impeller 30. The impeller 30 further includes a hub 31, a bottom plate 32 and a plurality of blades 33 formed thereon.

Still referring to FIG. 1(*a*), the blades 33 urge the inlet air from the a flow path parallel to the axis of the impeller 30, outward radially away from the hub 31. However, such the conventional centrifugal fan suffers the problem that the noise caused by the uneven inlet airflow passing through the intake 11 and the impeller 13.

Another conventional centrifugal fan as shown in FIG. 1(*b*) is composed of a frame 10, a motor 20 and an impeller 30. Among these, the frame 10 includes two inlets including a first intake 11 and a second intake 12, and an outlet (not shown). A plurality of ribs 13 are formed in the second intake 12. The motor 20 mounted to the frame 10 is used to rotate the impeller 30. The impeller 30 further includes a hub 31, a bottom plate 32 and a plurality of blades 33 formed thereon.

However, the drawbacks of the conventional centrifugal fan are as follows. First, the inlet airflow through the first intake 11 and that through the second intake 12 interferes with each other and the disturbance as well as the noise thus occur. Furthermore, the noise occurs during the blades 33 cross the rib 13.

Therefore, there is a need in the art for solving the above-mentioned problems.

SUMMARY OF THE INVENTION

The object of the present invention is to reduce the noise of a centrifugal fan. The object of the present invention is achieved by (1) isolating the inlet airflow through the first intake and the inlet airflow through the second intake so as to eliminate the disturbance; (2) enlarging the interval between the first intake and the impeller so as to smooth the inlet airflow; and (3) providing the structure that the second blade and the rib form an intersection angle of about 90 degree as the second blade crosses the rib.

The centrifugal fan of the present invention comprises a frame, a rotatory means and an impeller. Among these, the frame has a first intake, a second intake, at least one air outlet (not shown) and a plurality of ribs. The rib crosses the second intake. The rotatory means such as a motor, mounted in the frame is used to rotate the impeller.

The impeller further includes a hub, a partition, a plurality of first blades and a plurality of second blades. Among these, the hub is coupled to the rotatory means such that the impeller can be rotated by means of the rotatory means. The partition extends outward along the radial direction of the hub so as to isolate the inlet air of the first intake and that of the second intake and thus reduce noise.

Additionally, the partition further has a first surface and a second surface opposite to each other. A plurality of first blades are formed on the first surface. The first blades are separated form the hub. That is, the first blades do not directly connect with the hub. Similarly, a plurality of second blades are formed on the second surface. The second blades are separated form the hub. That is, the second blades do not directly connect with the hub. The second blade and the rib form an intersection angle of about 90 degrees as the second blade crosses the rib. Therefore, the noise is reduced.

It should be noted that each of the first blades or the second blades selectively includes a cut corner formed thereon. In the first blades, the cut corner is adjacent to the edge of the first intake. In the second blades, the cut corner is adjacent to the edge of the second intake. In this manner, the interval between the first intake and the impeller is enlarged so as to reduce noise. Further, the first blades may be arranged asymmetrically or symmetrically with respect to the second blades.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1(*b*) depicts another conventional centrifugal fan;

FIG. 3 (*b*) depicts another embodiment of the impeller of the present invention illustrating the asymmetry arrangement and position of the cut corner;

FIG. 3(*c*) depicts another embodiment of the impeller of the present invention illustrating the symmetry arrangement and position of the cut corner;

FIG. 3(*d*) is a bottom view illustrating the centrifugal fan of the present invention; and FIG. 3(*e*) depicts further another embodiment of the impeller of the present invention.

DESCRIPTION OF THE PREFERRED EMBODIMENT

Figure 1A:
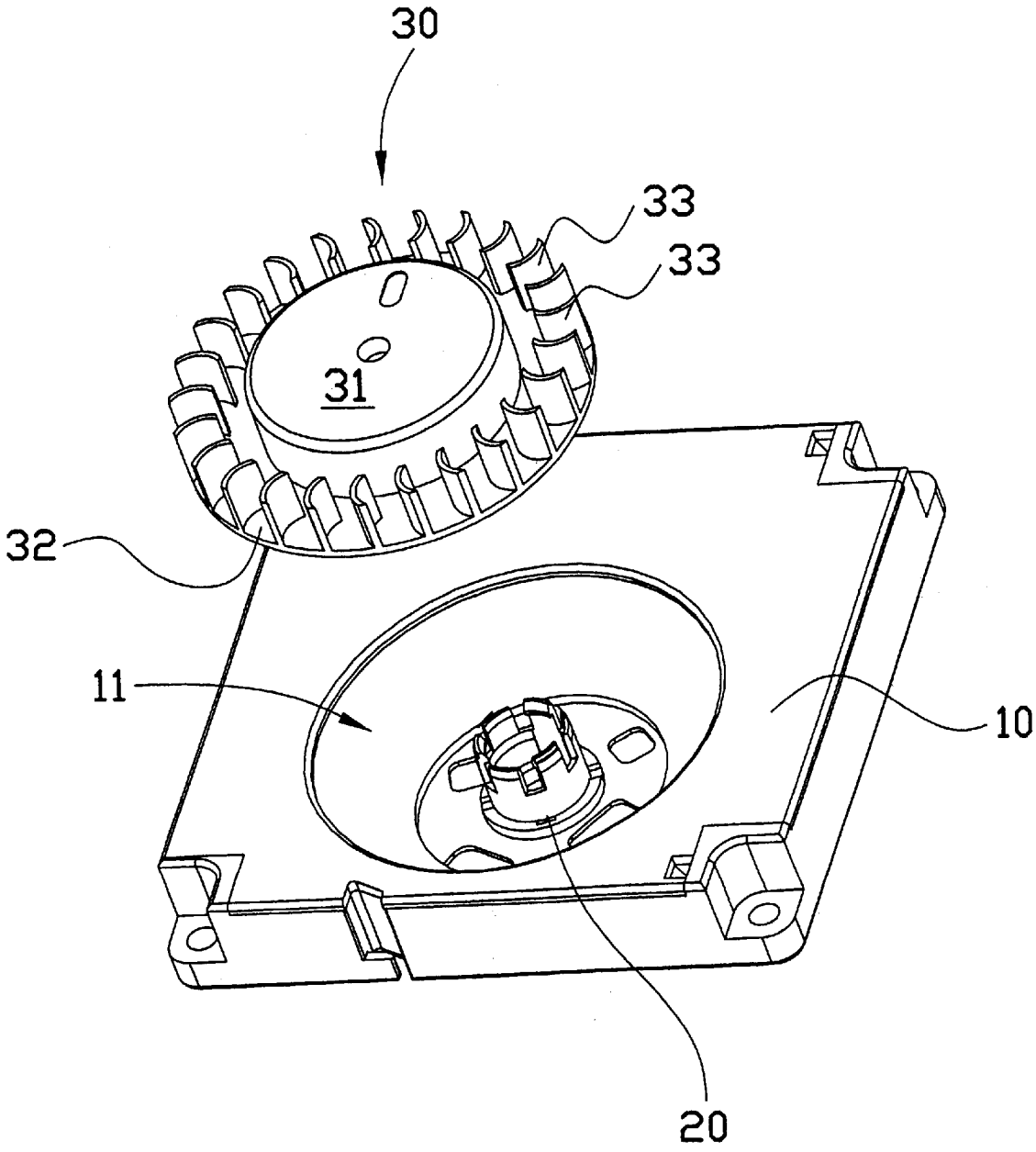
FIG. 1(a) PRIOR ART
FIG. 1(*a*) depicts a conventional centrifugal fan.
Figure 1B:
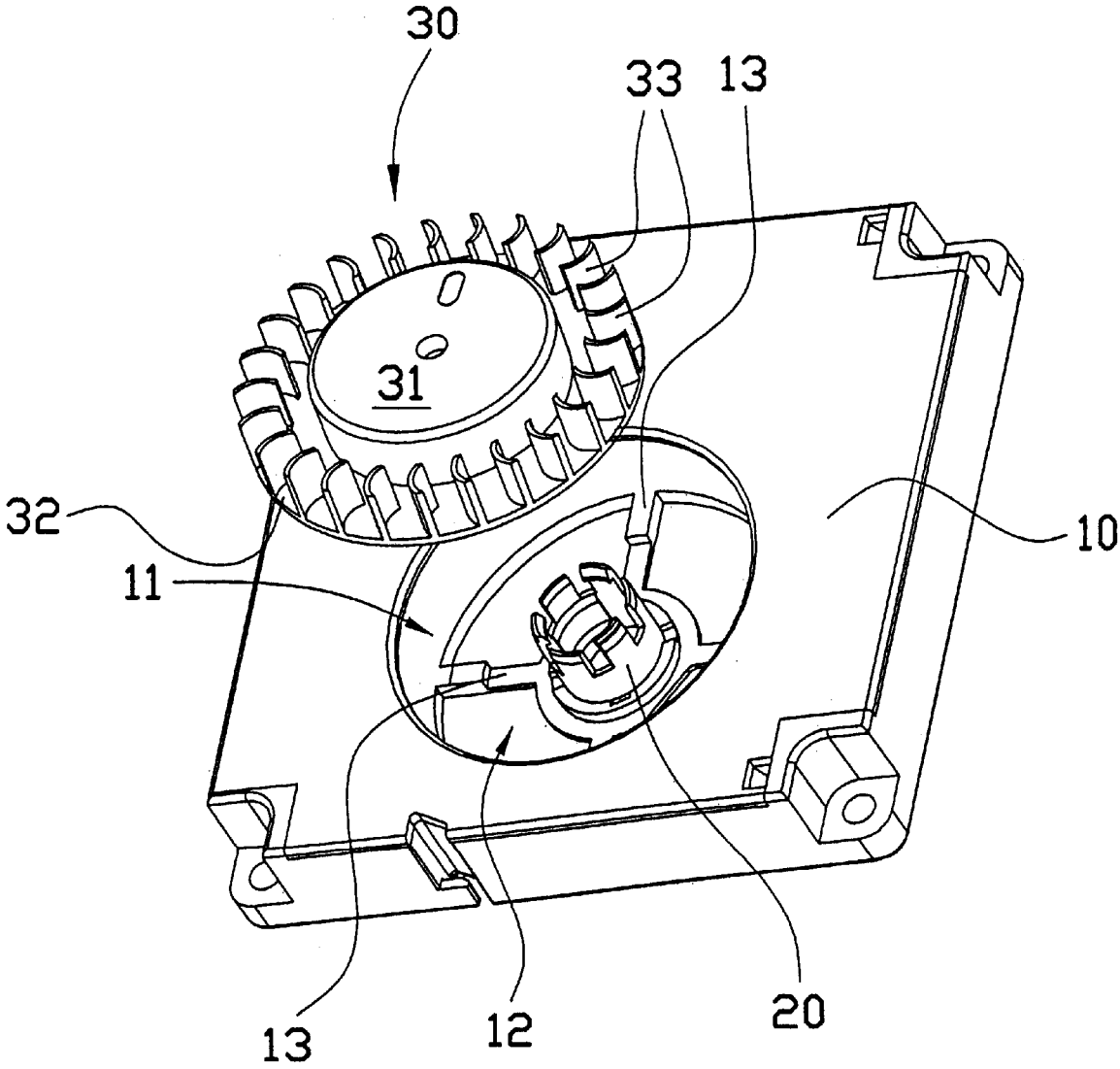
FIG. 1(b) PRIOR ART
Figure 2:
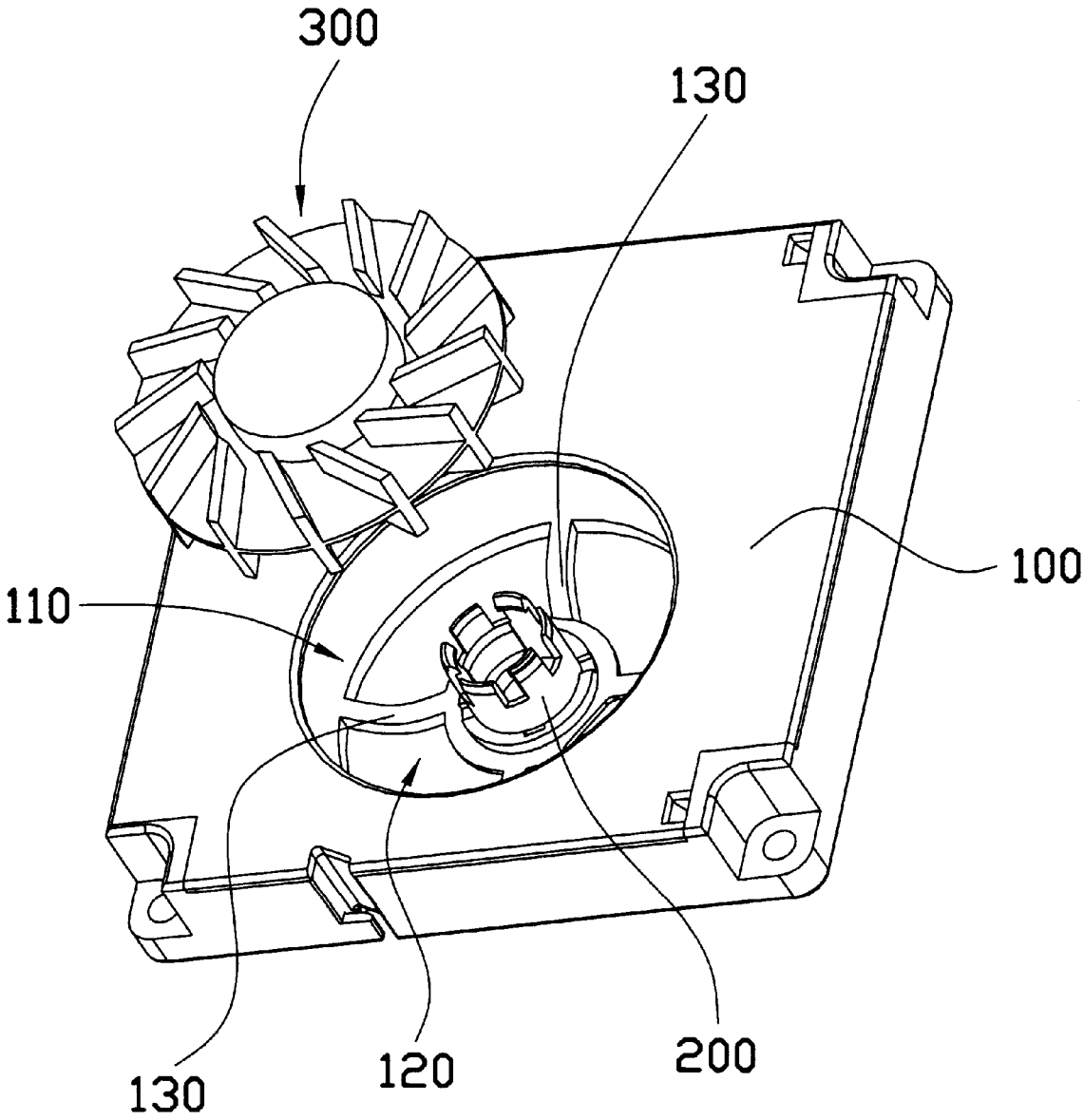
FIG. 2 is a exploded view illustrating the centrifugal fan of the present invention.
Figure 3A:
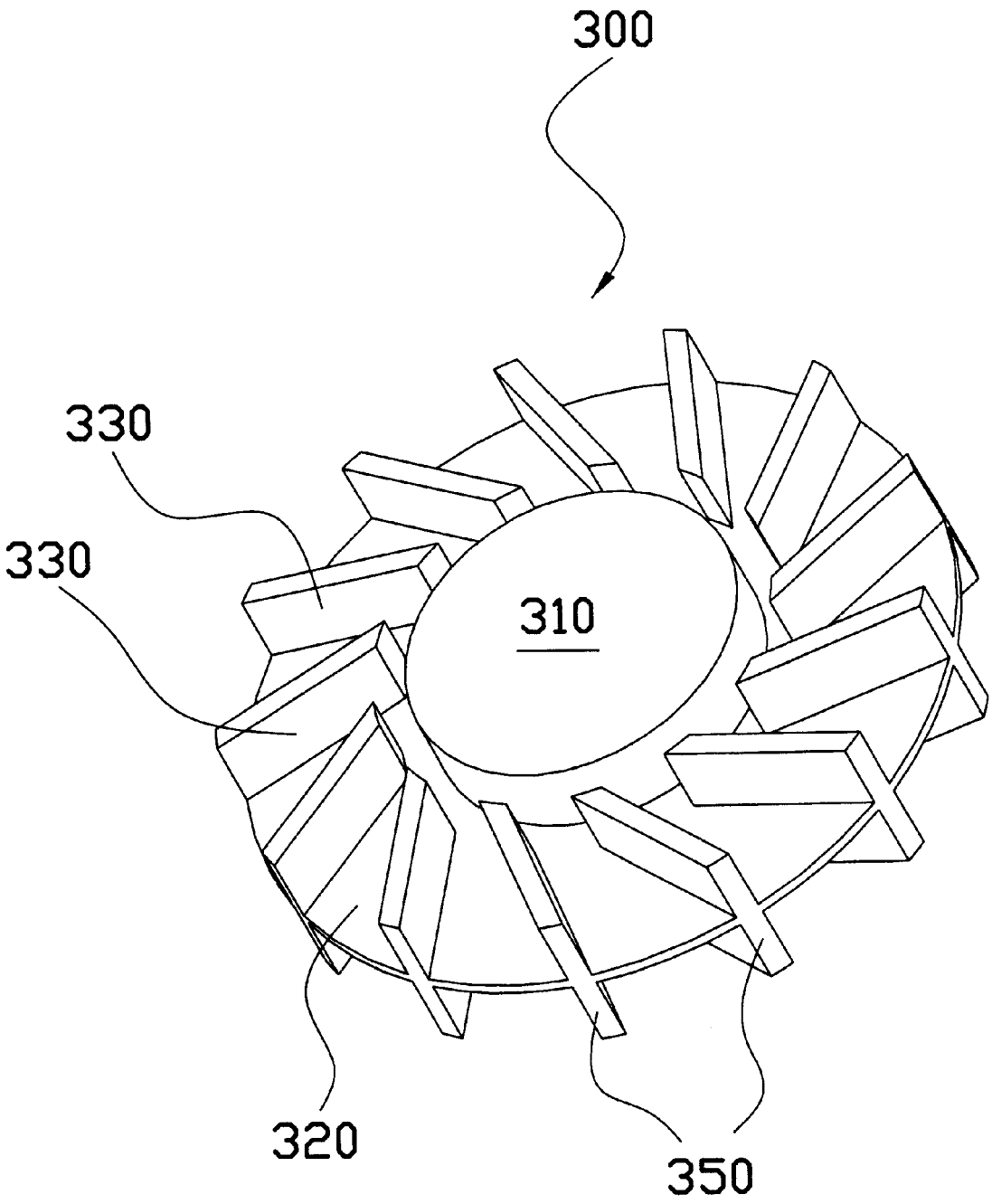
FIG. 3(*a*) depicts an embodiment of the impeller of the present invention.
Figure 3B:
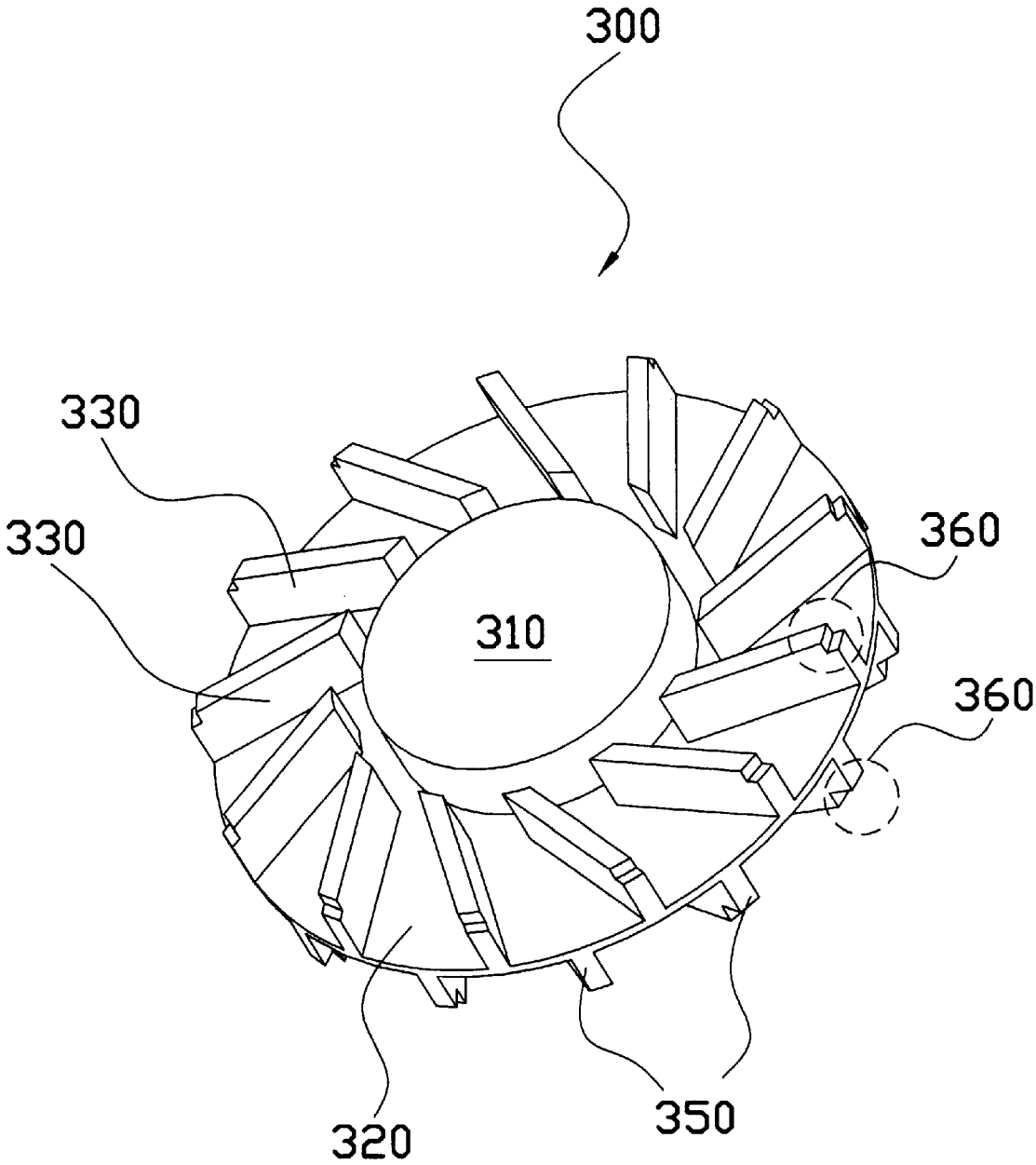
Figure 3C:
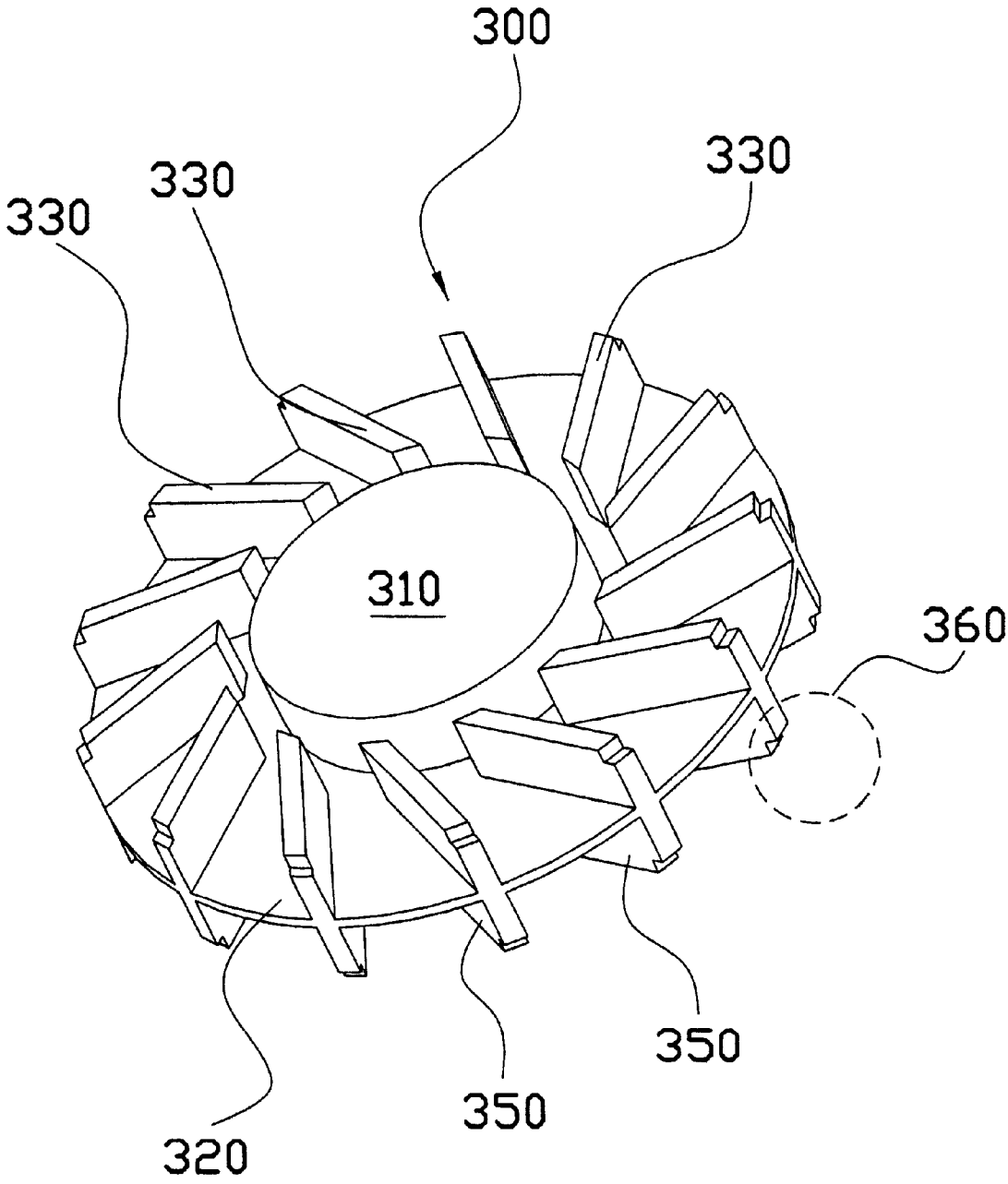
Figure 3D:
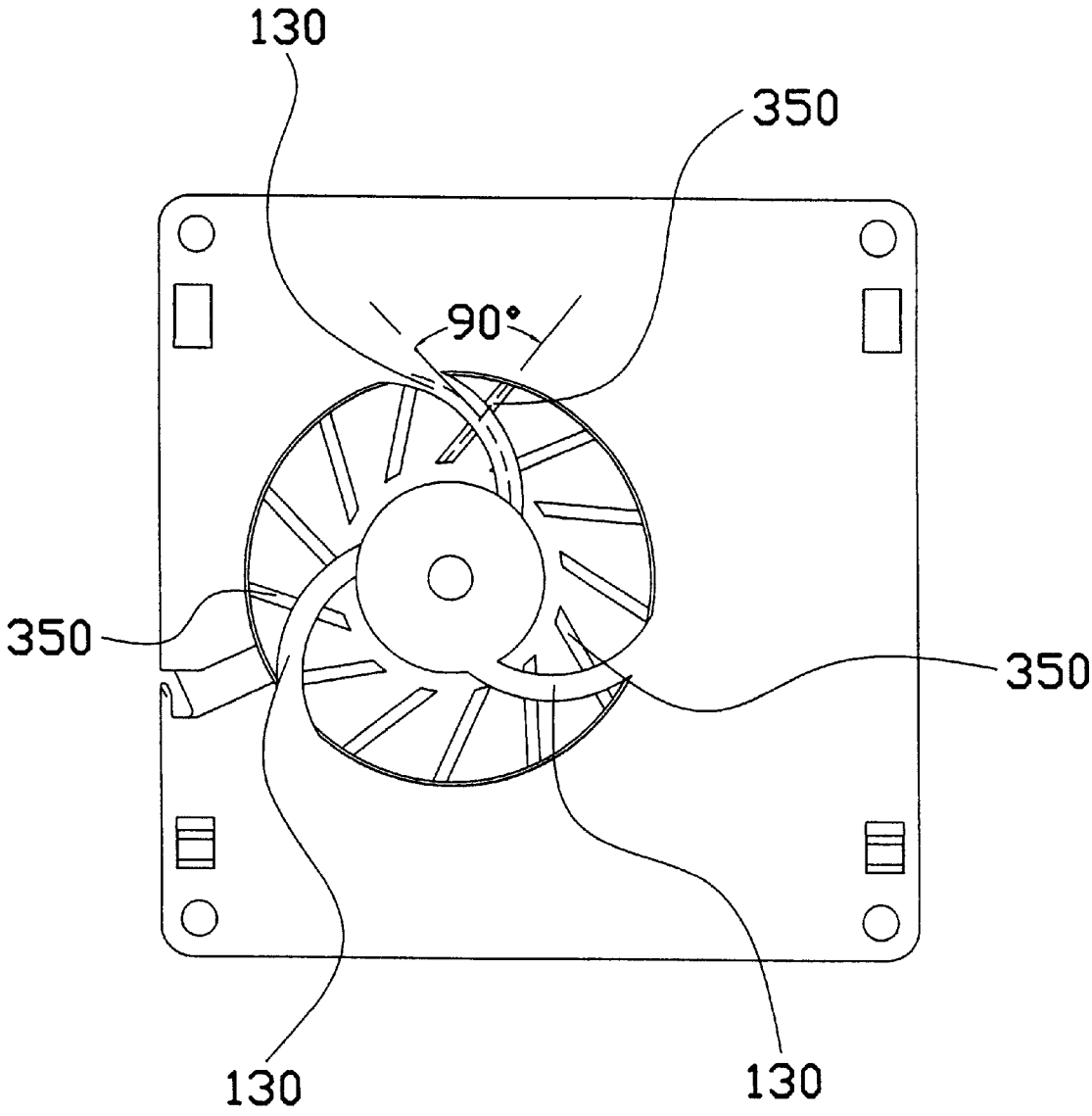
Figure 3E:
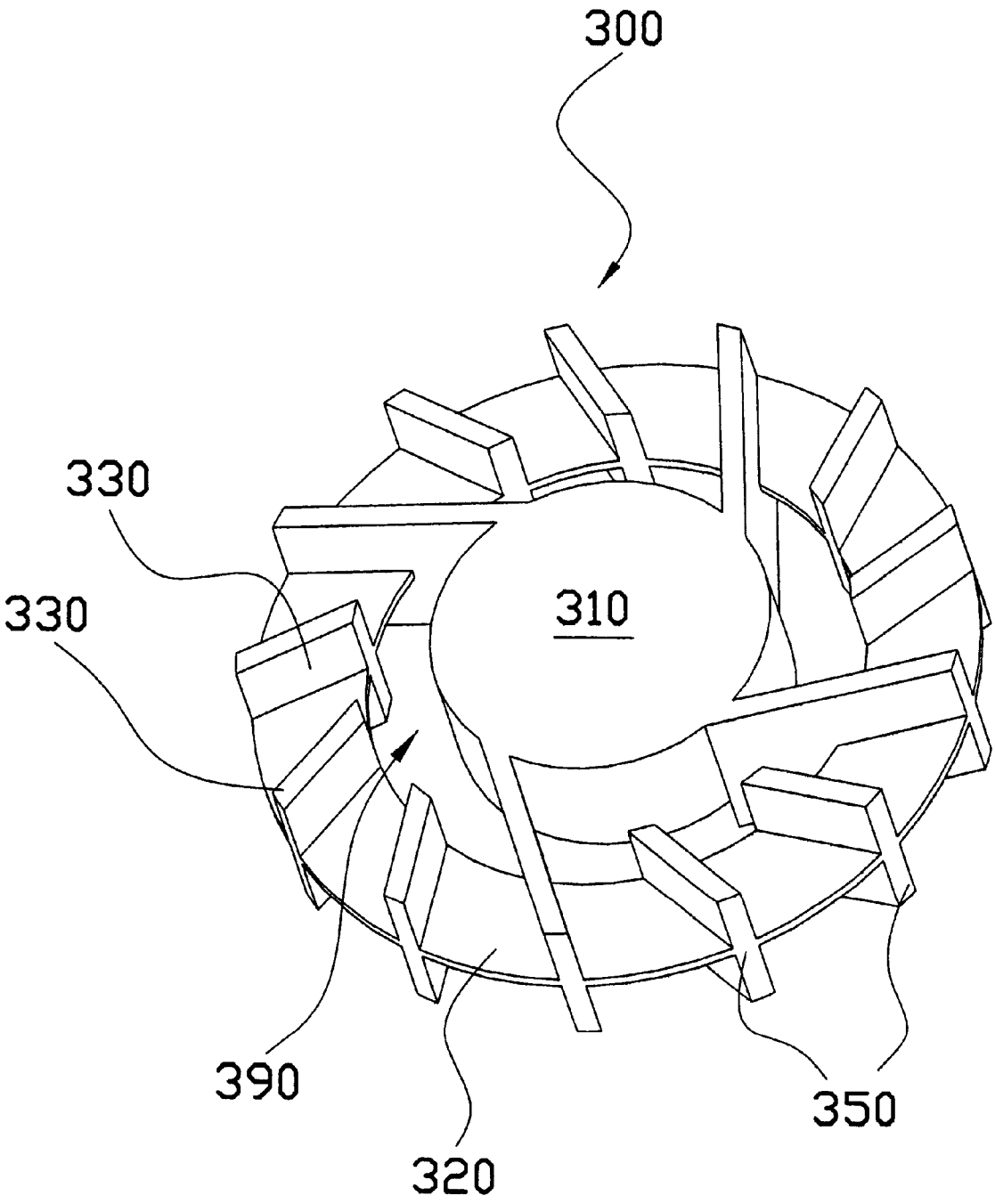

As shown in FIG. 2, the centrifugal fan of the present invention comprises a frame 100, a rotatory means 200 and an impeller 300. Among these, the frame 100 has a first intake 110, a second intake 120, at least one air outlet (not shown) and a plurality of ribs 130. The rib 130 crosses the second intake 120. The rotatory means 200, such as a motor, is mounted in the frame 100.

Referring to FIG. 2 and FIG. 3(*a*), the impeller 300 further includes a hub 310, a partition 320, a plurality of first blades 330 and a plurality of second blades 350. Among these, the hub 310 is coupled to the rotatory means 200 shown in FIG. 2 such that the impeller 300 can be rotated by means of the rotatory means 200. The partition 320 extends outward along the radial direction of the hub 310 so as to separate the inlet air of the first intake 110 and that of the second intake 120. The reduction in noise is achieved because the disturbance, resulted from the interference form the inlet airflow through the first intake 110 and that through the second intake 120, is significantly eliminated.

Still referring to FIG. 2, FIG. 3(*a*) and FIG. 3(*b*), the partition 320 further includes a first surface and a second surface opposite to each other. A plurality of first blades 330 are formed on the first surface. The first blades 330 are separated from the hub 310. That is, the first blades 330 do not directly connect with the hub 310. It should be noted that each of the first blades 330 selectively includes a cut corner 360 formed thereon. The cut corner 360 is adjacent to the edge of the first intake 110 so as to enlarge the interval between the first intake 110 and the impeller 300. Therefore, the noise is reduced.

Referring to FIG. 3(*c*) illustrating the bottom view of the present invention, a plurality of second blades 350 are formed on the second surface of the partition. The second blades 350 are separated from the hub 310. That is, the second blades 350 do not directly connect with the hub 310. It should be noted that each of the second blades 350 selectively includes a cut corner 360 formed thereon. The cut corner 360 is adjacent to the edge of the second intake 120 so as to enlarge the interval between the second intake 120 and the impeller 300. The noise is thus reduced. The second blades 350 are separated from the hub 310. That is, the second blades 350 do not directly connect with the hub 310.

The impeller 300 of the present invention is also shown in FIG. 3(*e*). The impeller 300 further includes a hub 310, a partition 320, a plurality of first blades 330 and a plurality of second blades 350. Among these, the hub 310 is coupled to the rotatory means 200 shown in FIG. 2 such that the impeller 300 can be rotated by means of the rotatory means 200. However, the partition 320 is located on the periphery of the hub. Besides, space 390 is formed between the partition 320 and the hub 310. That is, the partition 320 does not directly connect with the hub 310. The partition 320 further includes a first surface and a second surface opposite to each other. The plurality of first blades 330 and second blades 350 are formed on the first surface and the second surface, respectively. Among these, at least one first blade 330 or second blade 350 is connected with the hub 310. In this case, the partition 320 partially reduces the disturbance caused by the interference form the inlet airflow through the first intake 110 and that through the second intake 120. The noise is thus reduced. Besides, first blade 330 or second blade 350 selectively includes a cut corner (not shown) formed thereon.

Referring to FIG. 3(*d*) illustrating the bottom view of the present invention, it should be noted that the second blade 350 and the rib 130 form an intersection angle of about 90 degrees as each of the second blades 350 crosses the rib 130, thereby reducing noise.

Referring to FIG. 3(*a*)–(*c*) and FIG. 3(*e*), it should be noted that the first blades 330 may be arranged asymmetrically or symmetrically with respect to the second blades 350. As shown in FIG. 3(*a*) and FIG. 3(*b*), the so-called asymmetrical arrangement means that the first blades 330 and the second blades 350, formed on different surfaces, are arranged alternatively with respect to each other. That is, the first blades 330 and the second blades 350 are formed on the relatively different position of different surfaces. Also, the so-called asymmetrical arrangement means that the number of the first blades 330 is different from that of the second blades 350. Alternatively, the arrangement meeting both of the above conditions still is considered as satisfying the asymmetrical arrangement.

As shown in FIG. 3(*c*), the first blades 330 may be arranged symmetrically with respect to the second blades 350. The so-called symmetrical arrangement means that the first blades 330 and the second blades 350 are formed on the relatively same position of the different surfaces. Alternatively, the number of the first blades 330 is the same from that of the second blades 350.

In the present invention, the noise is reduced because the partition isolates the inlet airflow through the first intake form that through the second intake. Besides, the cut corner enlarges the interval between the second intake and the impeller. The noise is thus reduced. Further, the second blade and the rib form an intersection angle of about 90 degrees as each of the second blades crosses the rib.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A centrifugal fan, comprising:

a frame, having a first intake, a second intake, at least one air outlet and a plurality of ribs crossing said second intake;

a rotatory means, formed in said frame;

an impeller, further comprising:

a hub, coupled to said rotatory means;

a partition, extending outward along a radial direction of said hub, said partition having a first surface and a second surface;

a plurality of first blades, formed on said first surface of said partition, said first blade separated form said hub, said first blade having a cut corner; and a plurality of second blades, formed on said second surface, said second blade separated from said hub;

wherein said second blade and said rib forming an intersection angle of about 90 degrees as said second blade crosses said rib.

2. The centrifugal fan according to claim 1, wherein said cut corner is adjacent to said first intake.

3. The centrifugal fan according to claim 1, wherein said first blades and are said second blades arranged asymmetrically with respect to each other.

4. The centrifugal fan according to claim 1, wherein said first blades and said second blades are arranged alternately with respect to each other.

5. The centrifugal fan according to claim 1, wherein said first blades and said second blades are formed on the relatively different position of said first and second surfaces, respectively.

6. The centrifugal fan according to claim 1, wherein said first a blades and said second blades have a different number, respectively.

7. The centrifugal fan according to claim 1, wherein said first blades and are said second blades arranged symmetrically with respect to each other.

8. The centrifugal fan according to claim 1, wherein said first blades and said second blades are formed on the relatively same position of said first and second surfaces, respectively.

9. The centrifugal fan according to claim 1, wherein said first blades and said second blades have the same number.

10. The centrifugal fan according to claim 1, wherein said partition isolates an inlet air of said first intake and an inlet air of said second intake to reduce noise.

11. The centrifugal fan according to claim 1, wherein said cut corner is used to enlarge the interval between said first intake and said impeller so as to reduce noise.

12.A centrifugal fan, comprising: a frame, having a first intake, a second intake, at least one air outlet and a plurality of ribs crossing said second intake;

a rotatory means, formed in said frame;

an impeller, further comprising:

a hub, coupled to said rotatory means;

a partition, extending outward along a radial direction of said hub, said partition having a first surface and a second surface;

a plurality of first blades, formed on said first surface of said partition, said first blade separated form said hub; and a plurality of second blades, formed on said second surface, said second blade separated from said hub;

wherein said second blade and said rib forming an intersection angle of about 90 degrees as said second blade crosses said rib.

13. The centrifugal fan according to claim 12, wherein said first blade and said second blade further includes a cut corner adjacent to said first intake or said second intake.

14. The centrifugal fan according to claim 12, wherein said first blades and are said second blades arranged asymmetrically with respect to each other.

15. The centrifugal fan according to claim 12, wherein said partition isolates an inlet air of said first intake and an inlet air of said second intake to reduce noise.

16. The centrifugal fan according to claim 12, wherein said cut corner is used to enlarge the interval between said first intake and said impeller so as to reduce noise.

17.A centrifugal fan, comprising:

a frame, having a first intake, a second intake, at least one air outlet and a plurality of ribs crossing said second intake;

a rotatory means, formed in said frame;

an impeller, further comprising:

a hub, coupled to said rotatory means;

a partition, on a periphery of said hub, said partition separated from said hub, said partition having a first surface and a second surface;

a plurality of first blades, formed on said first surface of said partition, said first blade separated form said hub; and a plurality of second blades, formed on said second surface, said second blade separated form said hub:

wherein at least one first blade or second blade connect with said hub, said second blade and said rib forms an intersection angle of about 90 degrees as said second blade crosses said rib.

18. The centrifugal fan according to claim 17, wherein said first blade and said second blade further includes a cut corner adjacent to said first intake or said second intake.

19. The centrifugal fan according to claim 17, wherein said first blades and are said second blades arranged asymmetrically with respect to each other.

20. The centrifugal fan according to claim 17, wherein said partition isolates an inlet air of said first intake and an inlet air of said second intake to reduce noise.

* * * * *